US005167491A

United States Patent [19]

Keller, Jr. et al.

[11] Patent Number: 5,167,491

[45] Date of Patent: Dec. 1, 1992

[54] HIGH TO LOW SIDE BYPASS TO PREVENT REVERSE ROTATION

[75] Inventors: Frederick J. Keller, Jr.; Louis E. Chaump, both of Indianapolis, Ind.

[73] Assignee: Carrier Corporation, Syracuse, N.Y.

[21] Appl. No.: 763,777

[22] Filed: Sep. 23, 1991

[51] Int. Cl.[5] ..... F04B 49/02

[52] U.S. Cl. ..... 417/28; 417/32; 417/292; 62/196.3

[58] Field of Search ..... 417/14, 32, 28, 292; 62/196.3, 193

[56] References Cited

U.S. PATENT DOCUMENTS

| | | | |
|---|---|---|---|
| 2,007,388 | 7/1935 | Tarleton | 62/196.3 X |
| 2,039,089 | 4/1936 | Koch | 62/196.3 X |
| 2,331,264 | 10/1943 | Carter | 62/196.3 X |
| 2,646,205 | 7/1953 | Rosenschold | 417/28 X |
| 3,759,057 | 8/1973 | English et al. | 417/292 X |
| 4,820,130 | 4/1989 | Eber et al. | 417/292 X |

*Primary Examiner*—Leonard E. Smith

[57] ABSTRACT

Rotary compressors such as screw compressors and scroll compressors are capable of reverse operation at shutdown as the system pressure seeks to equalize through the running gear. The present invention provides a valved bypass which is opened responsive to the initiation of stopping the compressor. The valve bypass may be located internally or externally with respect to the compressor.

7 Claims, 3 Drawing Sheets

HIGH TO LOW SIDE BYPASS TO PREVENT REVERSE ROTATION

BACKGROUND OF THE INVENTION

Rotary compressors generally are capable of reverse operation wherein they act as expanders. Reverse operation can occur at shutdown when the closed system seeks to equalize pressure via the compressor thereby causing the compressor to run as an expander with negligible load. This problem has been addressed by providing a discharge check valve, as exemplified by commonly assigned U.S. Pat. No. 4,904,165, wherein the check valve is located as close as possible to the scroll discharge to minimize the amount of high pressure gas available to power reverse operation. As long as any high pressure gas is available to power reverse operation, some movement of the orbiting scroll will take place with attendant noise even if there is no attendant danger to the scroll compressor. Even if not harmful, the noise can be annoying and its reduction and/or elimination is desirable.

Scroll compressors in addition to tending to run in a reverse direction at shutdown also self unload at shutdown. The scrolls must be held in sealing contact in opposition to the forces exerted by the gas being compressed. Typically, the axial forces tending to hold the scrolls in contact, the axial compliancy, is supplied by fluid pressure acting against a scroll member from one or more pockets supplied with discharge and/or intermediate pressure. Leakage from the pockets(s) normally coacting with gravity axially separates the scrolls to provide leakage at the wrap tips thereby unloading the compressor, if not already unloaded, independent of radial movement of the scrolls due to gas forces acting on the scroll or gravity causing leakage at the wrap flanks and thereby unloading the compressor. Thus, scroll compressors are inherently unloaded a short while after stopping and remain unloaded until restarted and thereby have an easy start since they do not have to start against a pressure head. In contrast, other compressors generally are not self unloading except where reverse operation takes place with its attendant problems. As a result, it is common to unload reciprocating compressors, for example, at shutdown or start up in order to have an easy start. This approach is exemplified by U.S. Pat. Nos. 2,039,089; 2,579,439; and 2,715,992. Unloading and the use of variable speed for capacity control are well known. Thus, scroll compressors are unloaded only as part of a continuing operation responsive to demand or inherently as a consequence of stopping the compressor. Scroll compressors are not unloaded prior to shutoff as a part of the shutting off procedure or at shutoff by providing preferential bypass.

SUMMARY OF THE INVENTION

The tendency for reverse operation of a scroll compressor upon shutoff is overcome by providing a fluid path between the discharge and suction side of a compressor just prior to shutoff. Communication between the suction and discharge side is continued for a short while after the compressor is shutoff. Alternatively, communication can be established at shutoff if the amount of gas to be relieved and the flow path are such that pressure equalization can take place rapidly enough. Specifically, it requires that at the end of the short period in which it takes the orbiting scroll to come to a stop there is not sufficient energy to overcome the inertia of the orbiting scroll and initiate reverse operation.

It is an object of this invention to unload a compressor such that there will be no tendency for reverse operation at shutoff.

It is another object of this invention to reduce noise at shutdown.

It is a further object of this invention to minimize the energy loss due to unloading the compressor as a part of the shutdown procedure. These objects, and others as will become apparent hereinafter, are accomplished by the present invention.

Basically, the discharge side of a compressor is bypassed or unloaded to the suction side such that when the compressor is shutoff, there will not be sufficient energy available on the discharge side to drive the compressor in reverse.

BRIEF DESCRIPTION OF THE DRAWINGS

For a fuller understanding of the present invention, reference should now be made to the following detailed description thereof taken in conjunction with the accompanying drawings wherein.

DESCRIPTION OF PREFERRED EMBODIMENTS

Figure 1:
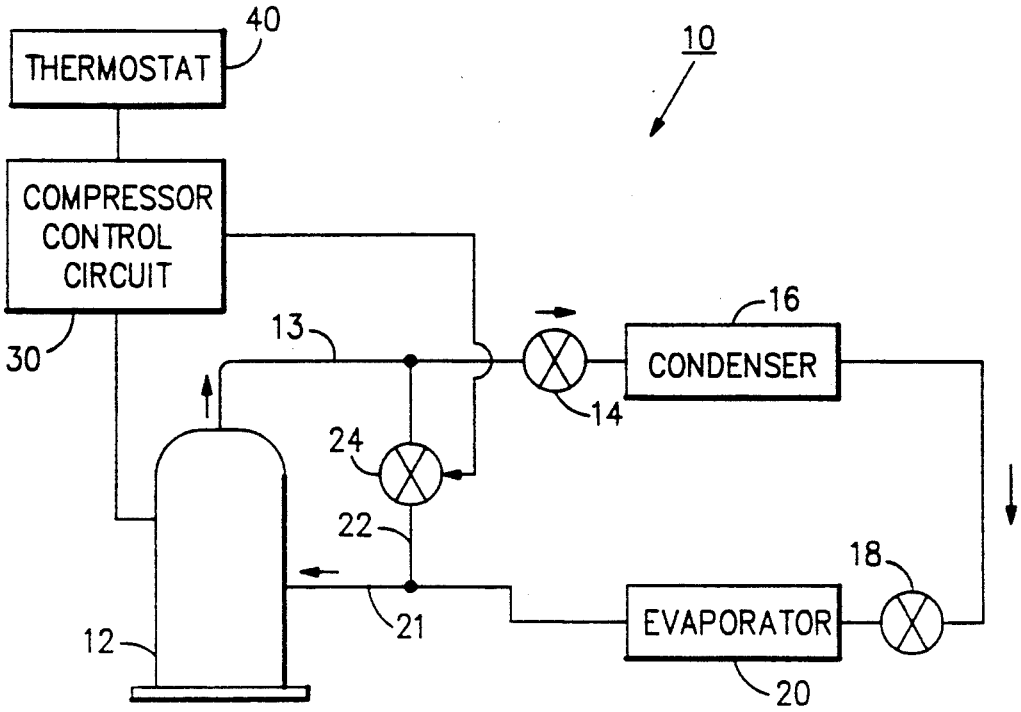
FIG. 1 is a schematic representation of a refrigeration system employing the present invention.
Figure 6:
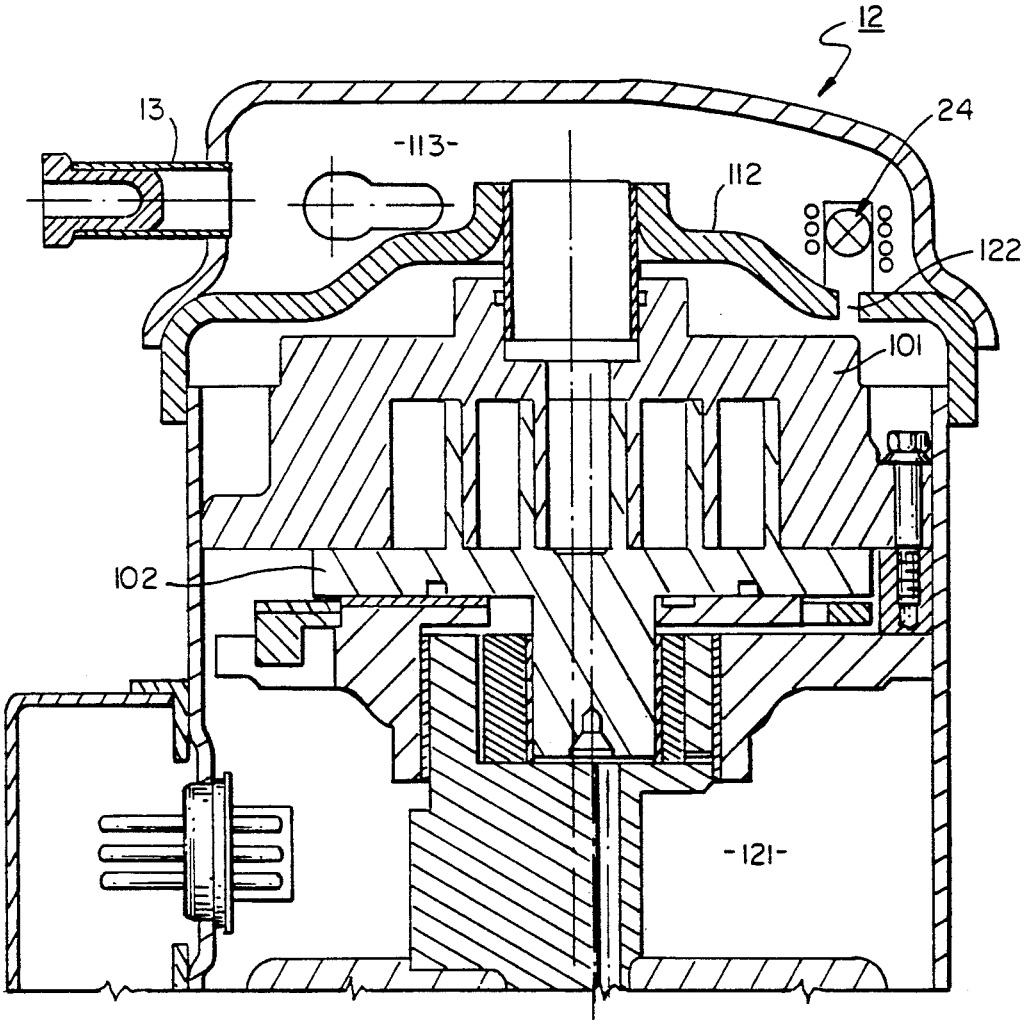
FIG. 6 is a partial, sectional view of a scroll compressor showing a second embodiment of the invention.

In FIG. 1, the numeral 10 generally indicates a refrigerating or air conditioning system. Compressor 12 is a rotary compressor, such as a screw compressor or scroll compressor, which will tend to run backwards upon shutdown as the pressure in system 10 tends to equalize through compressor 12. The refrigeration circuit serially includes the four basic elements which are, namely, compressor 12, condenser 16, expansion device 18 and evaporator 20. Additionally, as is conventional where the compressor is capable of reverse operation at shutdown, a check valve 14 is located at a point intermediate the outlet of the running gear of compressor 12 and condenser 16. The check valve 14 may be located within the shell of compressor 12 as disclosed in commonly assigned U.S. Pat. No. 4,904,165. The system described above is generally conventional and if the evaporator 20 is the inside coil, the space will be cooled whereas if condenser 16 is the inside coil, the space will be heated. The present invention adds a valved bypass extending from the discharge side of compressor 12 at a point upstream of check valve 14 to the suction side of the compressor 12 at a point downstream of evaporator 20. The valved bypass may be external to the compressor 12 as illustrated in FIG. 1 or internal to the compressor as illustrated in FIG. 6.

The operation of compressor 12, and thereby system 10, is responsive to thermostat 40 through compressor control circuit 30 which includes a microprocessor (not illustrated).

In operation of the refrigeration system 10, compressor 12 is started responsive to a cooling demand sensed by thermostat 40 and delivers refrigerant gas at a high temperature and pressure to condenser 16 where the refrigerant gives up heat and condenses. The liquid refrigerant passing through expansion device 18 is partially flashed and passes to the evaporator 20 where the remaining liquid refrigerant takes up heat and evaporates. The gaseous refrigerant returns to the compressor 12 to complete the cycle. When thermostat 40 is satisfied, compressor control circuit 30 causes compressor 12 to be shutoff.

The present invention, as noted above, adds a valved bypass which, as illustrated in FIG. 1, includes bypass line 22 extending between discharge line 13 and suction line 21 and containing normally closed solenoid valve 24. This change provides an alternative flow path for equalizing the pressure in system 10 other than through compressor 12 with its attendant reverse operation of compressor 12. Specifically, the normally closed solenoid valve 24 is opened in association with the stopping of compressor 12 which provides a direct flow path between the discharge line 13 at a point upstream of check valve 14 and suction line 21. The opening of valve 24 thus establishes a bypass flow which unloads compressor 12 without requiring flow through the running gear. Referring specifically to FIG. 6, the running gear would include fixed scroll 101 and orbiting scroll 102.

Figure 2:
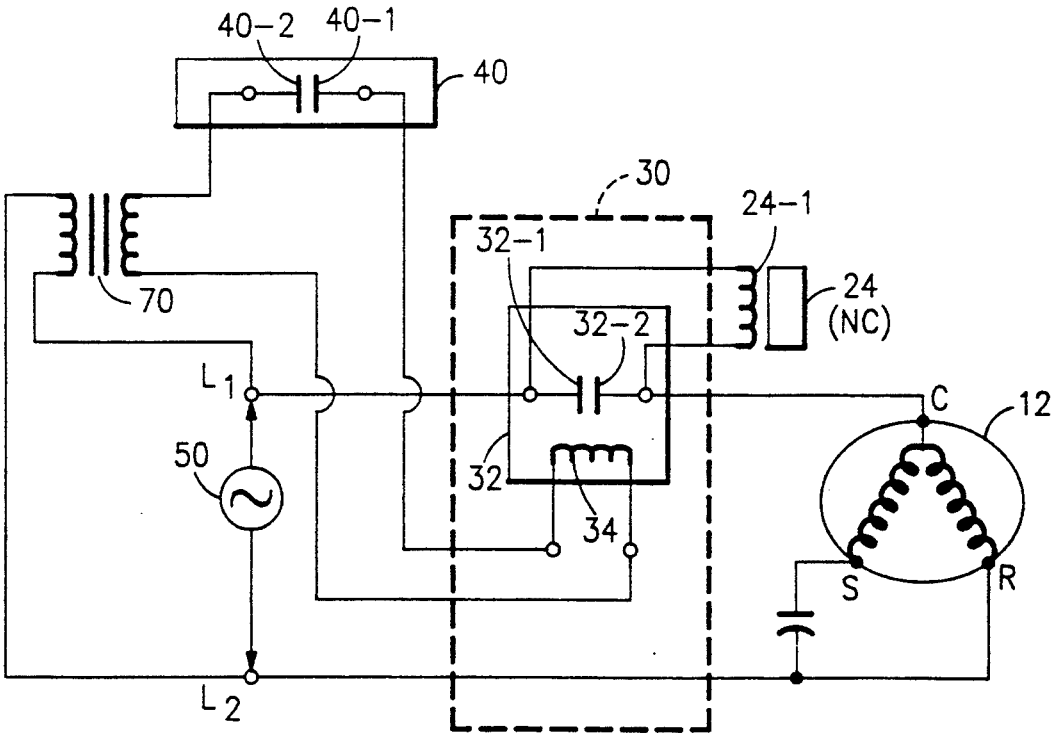
FIG. 2 is a schematic representation of a simplified electrical control circuit.

Referring specifically to FIG. 2, it will be noted that compressor 12 is connected to power source 50 via leads $L_1$ and $L_2$ and has common winding contact C, run winding contact R and start winding contact S. Contact C is connected to lead $L_1$ and contacts S and R are connected to lead $L_2$. Compressor contactor 32 is located in lead $L_1$ and includes normally open contacts 32-1 and 32-2. Coil 24-1 of solenoid valve 24 is connected across contacts 32-1 and 32-2. Coil 34 is powered from transformer 70 responsive to a cooling demand sensed by thermostat 40 which causes contacts 40-1 and 40-2 to close. Closing contacts 40-1 and 40-2 powers coil 34 causing contacts 32-1 and 32-2 to close which causes compressor 12 to run. As long as contacts 32-1 and 32-2 are closed, the parallel path containing solenoid coil 24-1 has too high of a resistance for coil 24-1 to be powered. When thermostat 40 is satisfied, contacts 40-1 and 40-2 open and coil 34 is placed in an open circuit which causes contacts 32-1 and 32-2 to open. With contacts 32-1 and 32-2 open, a continuous circuit is still serially defined by lead $L_1$, solenoid coil 24-1, contact C, contact R and lead $L_2$. This series circuit is capable of powering solenoid coil 24-1 thereby opening valve 24 and bypass line 22 but is not capable of driving compressor 12.

In the operation of the FIG. 2 embodiment, valve 24 is opened at the same time the compressor 12 is stopped and this requires a very rapid equalization of pressure to avoid reverse operation. The volume of the high pressure gas upstream of check valve 14, the cross section and length of the bypass flow path, and the pressure differential between suction and discharge all influence the equalization time.

Figure 3:
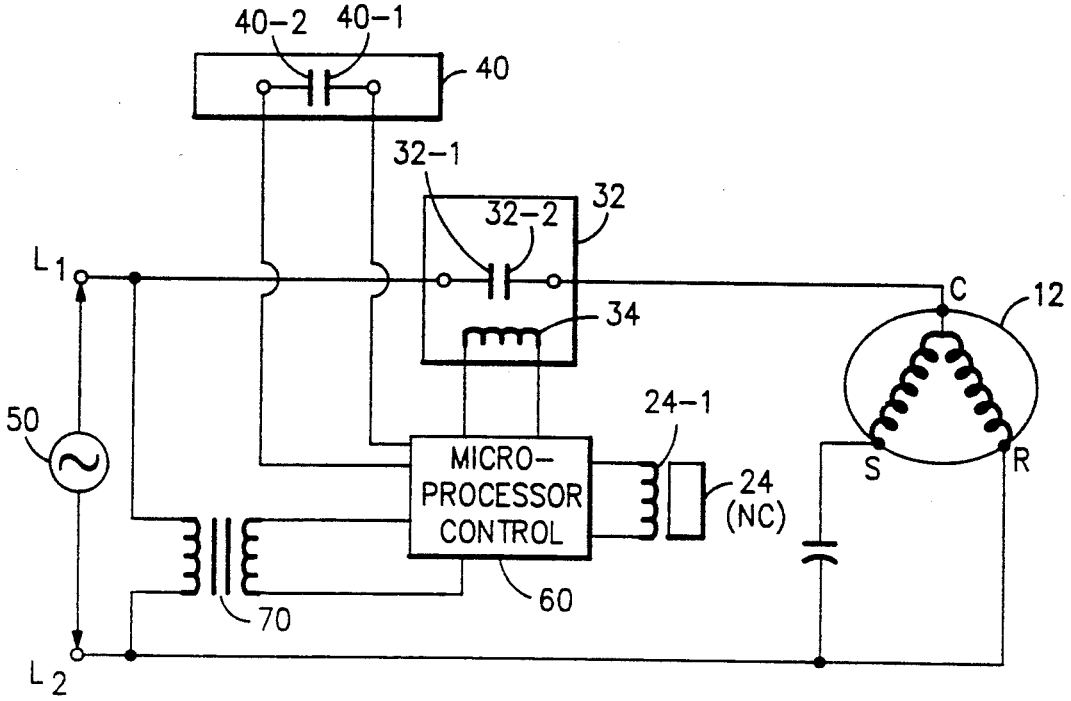
FIG. 3 is a modified representation of a simplified electrical control circuit.
Figure 4:
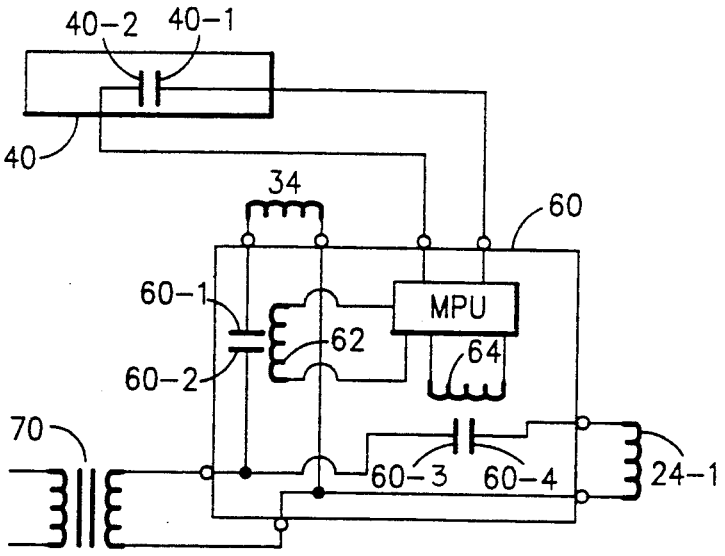
FIG. 4 is a detailed representation of the microprocessor control of FIG. 3.

In the embodiment of FIGS. 3 and 4, microprocessor control 60 is powered via transformer 70 and relates the opening of solenoid valve 24 to the shutting off of compressor 12. Microprocessor unit, MPU, is connected to thermostat 40, coil 62 and coil 64 as well as power source 50 via transformer 70. As in the FIG. 2 embodiment, contacts 32-1 and 32-2 are closed when coil 34 is powered responsive to the sensing of the cooling or heating requirement by thermostat 40 and the resulting closing of contacts 40-1 and 40-2. Specifically, with contacts 40-1 and 40-2 closed, MPU powers coil 62 causing contacts 60-1 and 60-2 to close thereby energizing coil 34 which, in turn, causes contacts 32-1 and 32-2 to close connecting compressor 12 to the power source 50 via leads $L_1$ and $L_2$.

Figure 5:
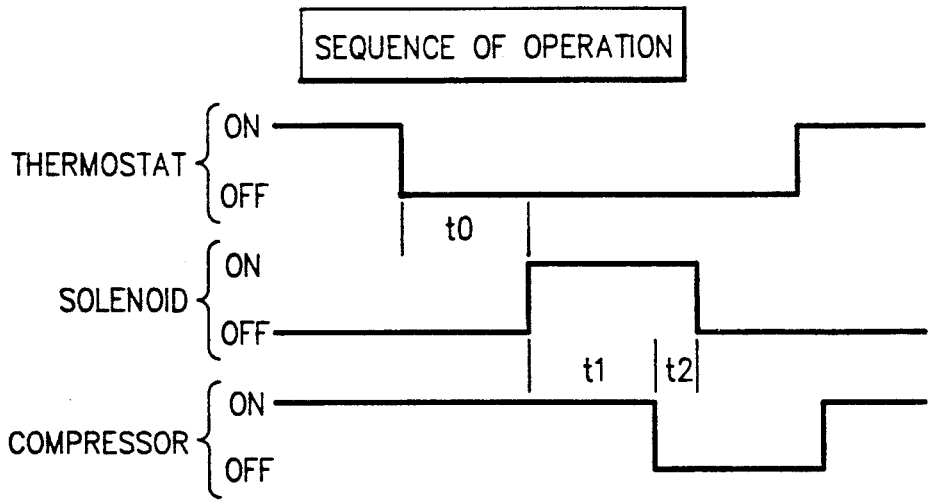
FIG. 5 is a graph showing the sequence of operation of the thermostat, bypass valve and compressor.

When thermostat 40 is satisfied, a sequence is started which is represented by the graph of FIG. 5. Specifically, when compressor 12 is running, contacts 32-1 and 32-2 are closed. Upon thermostat 40 becoming satisfied, contacts 40-1 and 40-2 open. MPU detects that the thermostat contacts 40-1 and 40-2 have opened, causing MPU to initiate a time delay for a period, $t_O$. After time interval $t_o$, MPU causes coil 64 to be energized causing contacts 60-3 and 60-4 to close. With contacts 60-3 and 60-4 closed, solenoid coil 24-1 is energized causing solenoid valve 24 to open and establish a bypass or unloading communication between discharge line 13/discharge plenum 113 and suction line 21/suction plenum 121 via valve 24. After a time period, $t_1$, has elapsed MPU deenergizes coil 62 causing contacts 60-1 and 60-2 to open causing coil 34 to be deenergized thus causing contacts 32-1 and 32-2 to open and compressor 12 to stop while valve 24 remains open. After an additional time period, $t_2$, has elapsed, MPU deenergizes coil 64 causing contacts 60-3 and 60-4 to be opened causing coil 24-1 to be deenergized and valve 24 to close. It will be noted that coil 24-1 is only powered for a time period equal to $t_1$ plus $t_2$ and that the bypassinq or unloading is initiated prior to shutting off the compressor 12 and continues for a short period of time, $t_2$, after compressor 12 is shut off.

There are optimum time intervals which result in proper protection from reverse rotation with minimal degradation of the system SEER, seasonal energy efficiency ratio. Time interval $t_1$ is the time which the valve 24 is opened prior to deenergizing the compressor motor. If $t_1$ is too short, compressor 12 will rotate in the reverse direction, generating noise and possible creating reliability problems if sufficient energy is available. However, if this interval is too long, the high to low side leak will result in significantly reduced system SEERs since the compressor 12 will be running but not doing any beneficial work. The optimum length of $t_1$ has been determined to be between 100 msec and 2,000 msec. Time interval $t_2$ is the time interval between when the compressor 12 is deenergized and the valve 24 is closed. In the case of an electrically actuated bypass method, as exemplified by solenoid valve 24, the electrical energy consumed during the time interval $t_2$ will reduce the SEER of the system. It is therefore desirable to minimize the length of $t_2$. However, the length of $t_2$ must be of sufficient length to prevent the high to low equalization from occurring through the scroll elements. If $t_2$ is too short, compressor 12 will still rotate in the reverse direction during shutdown. An optimum interval of 1,500 msec to 10,000 msec has been determined for the electrically actuated bypass arrangement. For a non-electrically actuated bypass method, the interval $t_2$ must be of sufficient duration to allow the high to low side pressure differential to drop to a low enough level that reverse rotation cannot occur when the bypass valve is reclosed. Although not needed for an easy start in a scroll compressor, in a mechanically actuated design, the bypass valve could be allowed to stay open until compressor 12 is restarted since electrical energy would not be consumed by the bypass valve during the compressor off cycle. The minimum time interval for $t_2$ for the mechanically actuated method is 1,500 msec.

Referring now to FIG. 6, the major distinction over the FIG. 1 configuration is that solenoid valve 24 is located within the shell of compressor 12 and controls port 122 in separator plate 112 rather than bypass line 22. The control configurations of FIGS. 2–4 would be suitable for use with the FIG. 6 embodiment.

Although preferred embodiments of the present invention have been illustrated and described, other changes will occur to those skilled in the art. It is therefore intended that the scope of the present invention is to be limited only by the scope of the appended claims.

What is claimed is:

1. A compressor means including running gear capable of reverse operation and having a suction means and a discharge means in an air conditioning system serially including said compressor means, said discharge means, check valve means, expansion means, evaporator means and said suction means, said system further comprising:

means for controlling said compressor means responsive to thermostatic demand;

bypass means connecting said suction means and said discharge means and bypassing said running gear; and valve means for opening said bypass means responsive to said means for controlling initiating stoppage of said compressor means.

2. The system of claim 1 wherein said bypass means is located externally of said compressor means.

3. The system of claim 2 wherein said valve means is a normally closed solenoid.

4. The system of claim 1 wherein said means for controlling causes said valve means to open a predetermined time period prior to stopping said compressor means.

5. The system of claim 4 wherein said means for controlling causes said valve means to close a predetermined time period after stopping said compressor means.

6. The system of claim 1 wherein said bypass means is located within said compressor means.

7. The system of claim 6 wherein said valve means is a normally closed solenoid.

* * * * *